US007023762B1

(12) United States Patent
Burkhardt et al.

(10) Patent No.: US 7,023,762 B1
(45) Date of Patent: Apr. 4, 2006

(54) DATE DISPLAY ASSEMBLY FOR AN ANALOG TIMEPIECE

(75) Inventors: Wolfgang Burkhardt, Ispringen (DE); Paul Grand-Chavin, Besancon (FR)

(73) Assignee: Timex Group B.V., (NL)

( * ) Notice: Subject to any disclaimer, the term of this patent is extended or adjusted under 35 U.S.C. 154(b) by 298 days.

(21) Appl. No.: 10/342,512

(22) Filed: Jan. 15, 2003

(51) Int. Cl.

| | |
|---|---|
| ***G04B 19/26*** | (2006.01) |
| ***G04B 19/24*** | (2006.01) |
| ***G04B 27/00*** | (2006.01) |
| ***G04B 19/02*** | (2006.01) |

(52) U.S. Cl. ..... 368/35; 368/37; 368/221; 368/233

(58) Field of Classification Search ..... 368/28, 368/31–38, 221, 233
See application file for complete search history.

(56) References Cited

U.S. PATENT DOCUMENTS

| | | | | |
|---|---|---|---|---|
| 2,976,672 | A * | 3/1961 | Ducommun | 368/37 |
| 3,779,001 | A * | 12/1973 | Kocher et al. | 368/38 |
| 3,939,645 | A * | 2/1976 | Charbonney | 368/35 |
| 4,257,113 | A * | 3/1981 | Meister et al. | 368/35 |
| 5,210,772 | A * | 5/1993 | Nakagawa | 375/139 |
| 5,305,291 | A * | 4/1994 | Kamens et al. | 368/252 |
| 5,446,703 | A * | 8/1995 | Schwartz | 368/80 |
| 5,742,565 | A * | 4/1998 | Cuinet et al. | 368/190 |
| 6,711,100 | B1 * | 3/2004 | Rochat et al. | 368/35 |

FOREIGN PATENT DOCUMENTS

| | | |
|---|---|---|
| DE | 4127825 C1 | 10/1992 |

* cited by examiner

*Primary Examiner*—Andrew H. Hirshfeld
*Assistant Examiner*—Leo T. Hinze
(74) *Attorney, Agent, or Firm*—Carmody & Torrance LLP

(57) ABSTRACT

A date display assembly for a timepiece, wherein the timepiece comprises a casing, an hour wheel that is rotationally engaged with a meshing wheel, and a display window for displaying a date, the date display assembly comprising an outer date ring having a plurality of digits thereon and aligned in the casing such that each of the plurality of digits is appearable in the display window; an inner date ring having a plurality of digits thereon and also aligned in the casing such that each of the plurality of digits is appearable in the display window; a date wheel, rotatably engageable with the meshing wheel, for driving the outer date ring in a first direction; and an inner date ring driving wheel, rotatably engageable with the outer date ring, for driving the inner date ring in a direction opposite the first direction.

5 Claims, 8 Drawing Sheets

DATE DISPLAY ASSEMBLY FOR AN ANALOG TIMEPIECE

BACKGROUND OF THE INVENTION

This invention relates generally to timepieces having a date display, and more particularly, to an improved assembly that is able to facilitate viewing of the date because the date display can be made larger than in conventional timepieces with date displays.

Providing a date window in a timepiece, such as in an analog or chronograph watch has been known for many years, and accordingly, the basic mechanism, gear and dial movements used in connection therewith are quite old in the art.

However, certain styles of watches are designed to be small, such as those designed for a small wrist, such as in certain ladies style watches. For example, certain watch styles are designed both in a large version for a man, and a somewhat smaller although identical version for a woman. Unfortunately, as the watch casing size decreases, the circumference of the date ring (and corresponding size of the numbers thereon) needs to decrease, thus resulting in a calendar date feature that may be considered harder to see.

Accordingly, it would be desirable to provide a way to increase the size of the date that is viewed through the display. One way, of course, would be to either increase the size of the numbers on the date ring or the space available to display the date. While these may be satisfactory in some instances, they are less satisfactory than desired.

A more promising way to achieve satisfactory date display sizing is to utilize two date rings, one of which having printed thereon numbers from 0–9, while the other having the digits 1–3 printed thereon. While one such example can be found in DE 41 27 825, a more relevant construction has been proposed and was incorporated in a watch hereinafter believed to be sold under the name RONDA. Three figures showing the RONDA construction are set forth in FIGS. 7 and 8. However, for various reasons, it has been determined that such a constructions is less than desirable. For example, while FIG. 7 simply illustrates the outer date ring 100 and the inner date ring 110. FIG. 8 more particularly illustrates the mechanical workings thereof.

Specifically, FIG. 8 illustrates how an outer ring driving wheel 120 can be positioned to drive inner date ring 110. In turn, outer date ring 100 can be seen to rotate an intermediate wheel 120, by the meshing of teeth 105 on outer date ring 100 and corresponding teeth 125 and formed valleys on the outer surface of intermediate wheel 120. Therefore, it can be readily seen that each daily rotation of outer date ring 100 causes a corresponding rotation of intermediate wheel 120.

Furthermore, on intermediate wheel 120 is a finger 130, which has been highlighted for the convenience of the reader. Also readily viewable is a center wheel 140 (with a 110. Accordingly, the rotation of centerwheel 140 correspondingly rotates inner date ring 110.

The rotation of centerwheel 140 is caused by the engagement of finger 130 with the plurality of teeth 145. This engagement can be seen to occur once every $10^{th}$ day. This is, each day outer date ring 100 can be seen to rotate about 360/20 degrees (taking into account that the outer ring digits are repeated only once). Likewise, each day, intermediate wheel rotates about 360/10 degrees, with finger 130 only engaging centerwheel 140 only once every $10^{th}$ day.

This construction gives rise to at least one significant perceived disadvantage.

Specifically, it can be seen that if intermediate wheel 120 is positioned with finger 130 in any of the 9 positions other than the only one which will cause the proper advancing of centerwheel 140 and thus inter date ring 110, it is likely that inner date ring 110 may be caused to advance when the "one" digit in the window (not show) is other than the numeral "9". This result may be caused due to a misalignment of intermediate wheel 120 during manufacture/repair of the watch itself, or may occur for example, if there is a meshing misalignment between teeth 125, for example (i.e. one of the teeth 105 may be damaged). Other easily envisioned misalignments are possible.

However, what is readily apparent is that the precision orientation of finger 130 with respect to the positioning of outer ring and/or the inner ring will be destroyed, thereby resulting in a permanent error in date advancement. For example, in one misalignment, the date will permanently advance for "08" to "19," "18" to "29" and "28" to "09). Such a result is not readily fixable by the user without taking the entire watch apart.

Therefore, further developments to improve the size of the data displayed in the date window by utilizing two date rings are desirous, and are achieved by the present invention.

SUMMARY OF THE PRESENT INVENTION

Generally speaking, it is an object to provide an improved date display assembly for a timepiece.

It is thus another object to provide a date display assembly that be incorporated into a small watch causing and still provide a desired display of the date.

Another object of the present invention is to provide a date display assembly that facilitates the reading of the date, even if the watch casing has been made smaller.

Another object of the present invention is to provide a date display assembly that can be manufactured easily and is very resilient to breakage or damage by a user.

Another object of the present invention is to facilitate the construction of such a date ring assembly, by using for example, a self-locking arrangement.

Still other objects and advantages of the invention will in part be obvious and will in part be apparent from the specification.

The invention accordingly comprises the features of construction, combination of elements and arrangement of parts which will be exemplified in the construction hereinafter set forth, and the scope of the invention will be indicated in the claims.

Therefore, in accordance with the present invention, and generally speaking, a date display assembly for a timepiece is provided. In a preferred embodiment, the timepiece comprises a casing, an house wheel that is rotationally engaged with a meshing wheel, and a display window for displaying a date, and the date display assembly comprises an outer date ring having a plurality of digits thereon and aligned in the casing such that each of the plurality of digits is appearable in the display window, wherein the outer date ring comprises at least two signaling notches spaced apart from one another; an inner date ring having a plurality of digits thereon and also aligned in the casing such that each of the plurality of digits is appearable in the display window; a date wheel, rotatably engageable with the meshing wheel, for rotating the outer date ring in a first direction; and an inner date ring driving wheel, rotatably engageable with the outer date ring, for rotating the inner date ring is a direction opposite the first direction.

One particular novel feature is that the inner date ring rotates upon each engagement of the at least two signaling notches with the inner date driving wheel. Another novel feature is that each rotation of the inner date driving wheel causes a rotation of the inner date ring. Still further, another novel feature is that the inner date ring driving wheel is provided with a plurality of first slots that engage both the notches on the outer date ring and a plurality of teeth associated with the inner date ring.

In another embodiment of the invention, the date display assembly comprises an outer date ring having a plurality of digits thereon and aligned in the casing such that each of the plurality of digits is appearable in the display window; an inner date ring having a plurality of digits thereon and also aligned in the casing such that each of the plurality of digits is appearable in the display window; wherein the outer date ring has an angled inner edge and the inner date ring has a complementary angled outer edge, wherein the angled inner edge of the outer date ring overlies and restricts the movement of the outer edge of the inner date ring towards the display window; and a lockdown ring, coupled to the casing, for locking down the outer date ring.

BRIEF DESCRIPTION OF THE DRAWINGS

The above set forth and other features of the invention are made more apparent in the ensuing Detailed Description of the Preferred Embodiments, when read in conjunction with the attached Drawings, wherein.

Identically labeled elements appearing in different ones of the above-described figures refer to the same elements but may not be referenced in the description for all figures.

DETAILED DESCRIPTION OF THE PREFERRED EMBODIMENTS

Prior to making specific reference to the Figures, it should be understood that omitted herein are certain basic and very well known concepts as to the construction and function of an analog or chronograph watch. Accordingly, reference shall be made only to the important and material features of the present invention, it being assumed that one skilled in the art would be well able to construct the basic, and underlying analog watch without reference having to be made to the present application. For example, it is assumed that one skilled in the art is well able to design and construct a timepiece that has a conventional date ring, such as one having 31 numbers around the periphery thereof, and a gearing arrangement in which the turning of a series of gears, such as the center, hour and minute gears, permits and causes the date ring to rotate accordingly.

Therefore, while what will now be disclosed will completely enable one skilled in the art to construct a timepiece that incorporates an improved two date ring assembly in accordance with the present invention, the application is drafted with the underlying assumption that the basic workings of an analog gear movement and date ring assembly are known.

Accordingly, taking the following disclosure in connection with the Figures herein, it will be seen that the present invention is directed to an improved date display assembly for a timepiece, which is generally indicated at 1. Timepiece 1 comprises a casing 10, and a setting stem generally indicated at 15, details of which will are well known in the art.

Figure 3:
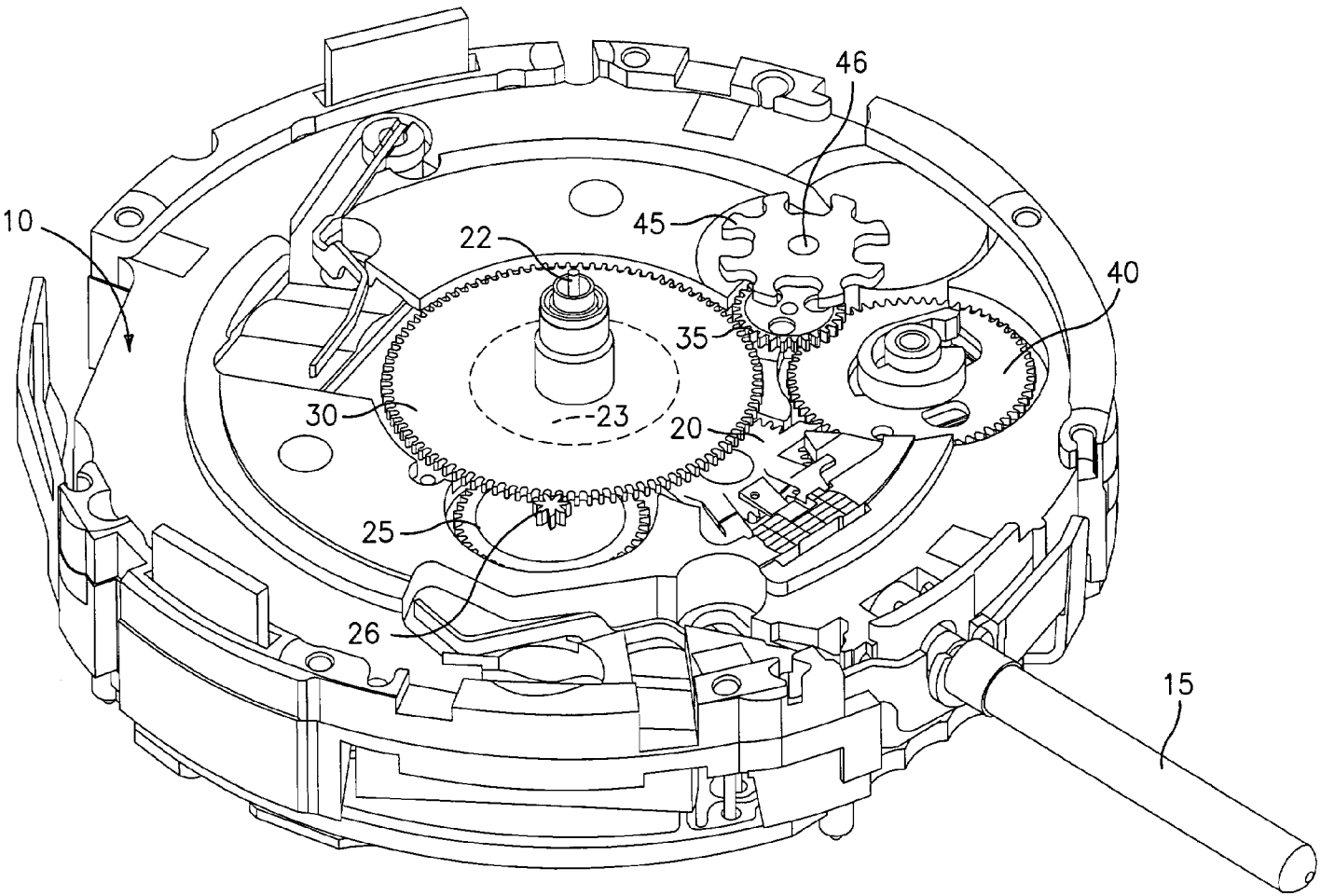
FIG. 3 is a perspective view of a timepiece constructed in accordance with the present invention, showing yet further features of the present invention, in particular, parts of the date display assembly and the gear train that enables the present invention.

From the disclosure of the patents and applications incorporated by reference herein and as set forth below, it should be well understood how setting stem 15 will preferably include a toothed wheel (not shown) that can rotatably engage a setting wheel 20. Setting wheel 20 in turn is in rotational engagement with a center wheel 23 (see FIG. 3) which is mounted on a center stem 22. A minute wheel 25 is mounted on or includes its own stem (not shown) and is in rotational meshing with center wheel 23. A pinion 26 on minute wheel 25 is in rotational engagement with an hour wheel 30, that is also mounted on center stem 22, all of which is well known in the art. A meshing wheel 35, mounted on (or including its own) stem (not shown), is rotatably engageable with hour wheel 30. A display window 3 is provided through a dial 5.

The objective of the present invention and as discussed below, is to maximize the size of the date digits that appear in date window 3, while keeping the overall size of the watch within a desired (i.e. small) size.

Figure 1:
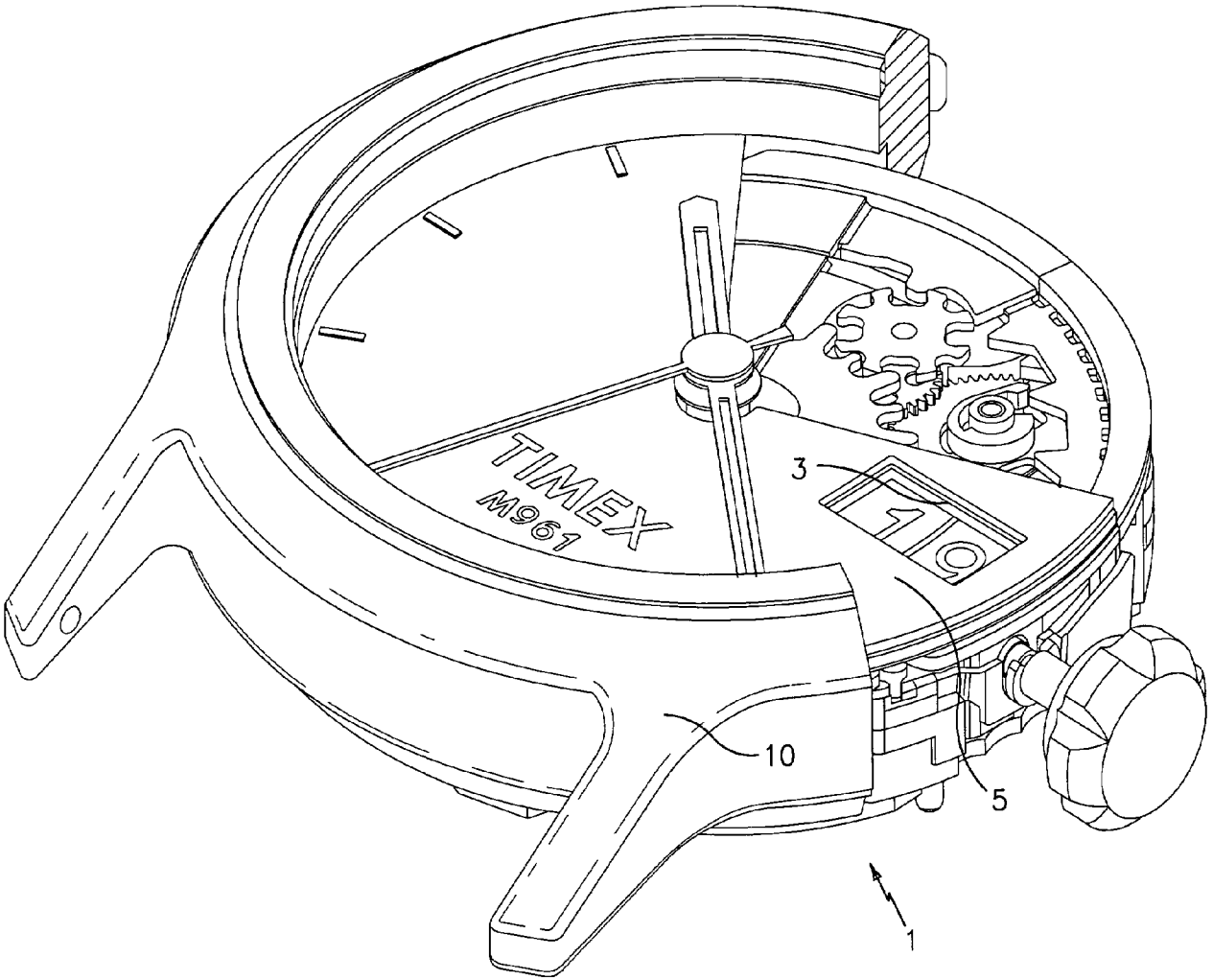
FIG. 1 is a perspective view of a timepiece constructed in accordance with the present invention, in which a section of the watch casing has been cut away to more particularly illustrate certain material elements thereof.
Figure 2:
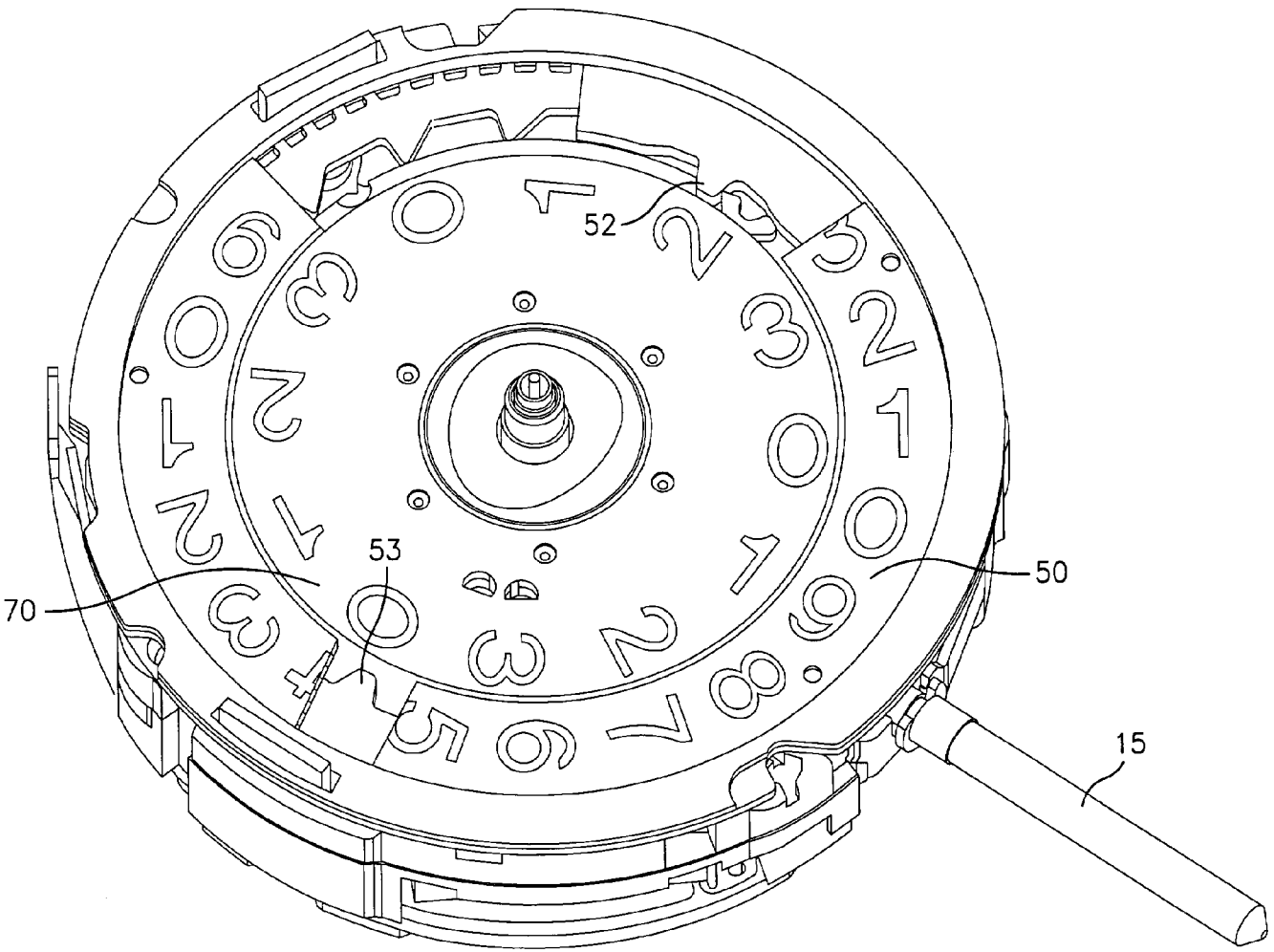
FIG. 2 is another perspective view of a timepiece constructed in accordance with the present invention, showing the incorporation of the two date ring assembly, along with other material elements being easily seen behind the date ring assembly.

Therefore, in accordance with the present invention, the date display assembly of the present invention comprises an outer date ring, generally indicated at 50, that has a plurality of digits (see FIG. 2) thereon (such as by printing them on or other known methods), all of which are aligned on the ring such that each of the digits will appear in display window 3 when outer date ring 50 rotates.

The date display assembly also comprises an inner date ring, generally indicated at 70, that also has a plurality of digits thereon (see FIG. 2), again such as by printing or the like. In a similar manner, ring 70 and the placement of the digits thereon are also aligned in the casing such that each of the digits can appear in display window 3.

As illustrated, the present invention contemplates that there two series of digits (0–9) on outer date ring 50 and three series of digits (0–3) on inner date ring 70. This 2:3 multiple is preferred because of the construction set forth below.

Driving outer date ring 50 is a date wheel 40 mounted on or including its own stem (not shown), which is rotatably engageable with meshing wheel 35, and in particularly with a pinion 37 (see FIG. 4) that is attached to or otherwise integral with meshing wheel 35. Use of pinion 37 provides for the correct turning ratio between hour wheel 30 and outer date ring 50, all of which should be understood by one skilled in the art. Details of the particular features and construction of date wheel 40 are discussed further below.

The date display assembly also comprises an inner date ring driving wheel 45, mounted on stem 49, rotatably engageable with outer date ring 50, for driving inner date ring 70 in a direction opposite the direction in which the outer date ring 50 turns.

Generally speaking the novelty of the present invention resides in the idea that hour wheel 30 drives meshing wheel 35 which in turn drives date wheel 40 which in turn drives outer date ring 50 which in turn drives inner date ring driving wheel 45 which in turn drives inner date ring 70. The coordinated gearing action and the particulars of each of the aforementioned elements to carry out this novel method of date display shall now be disclosed.

Figure 4:
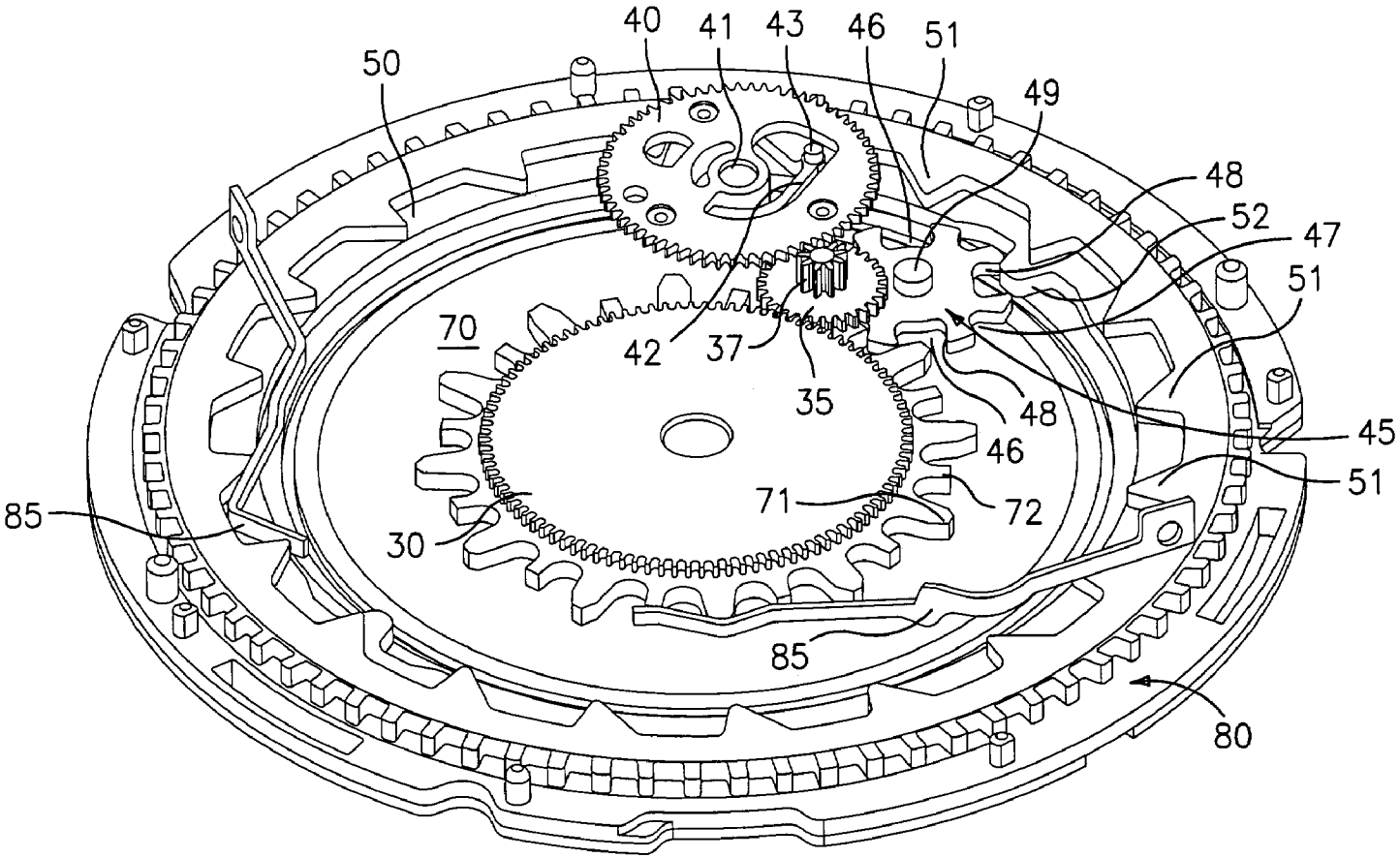
FIG. 4 is a perspective view of the underside of the date rings, again illustrating elements material to the present invention.
Figure 5:
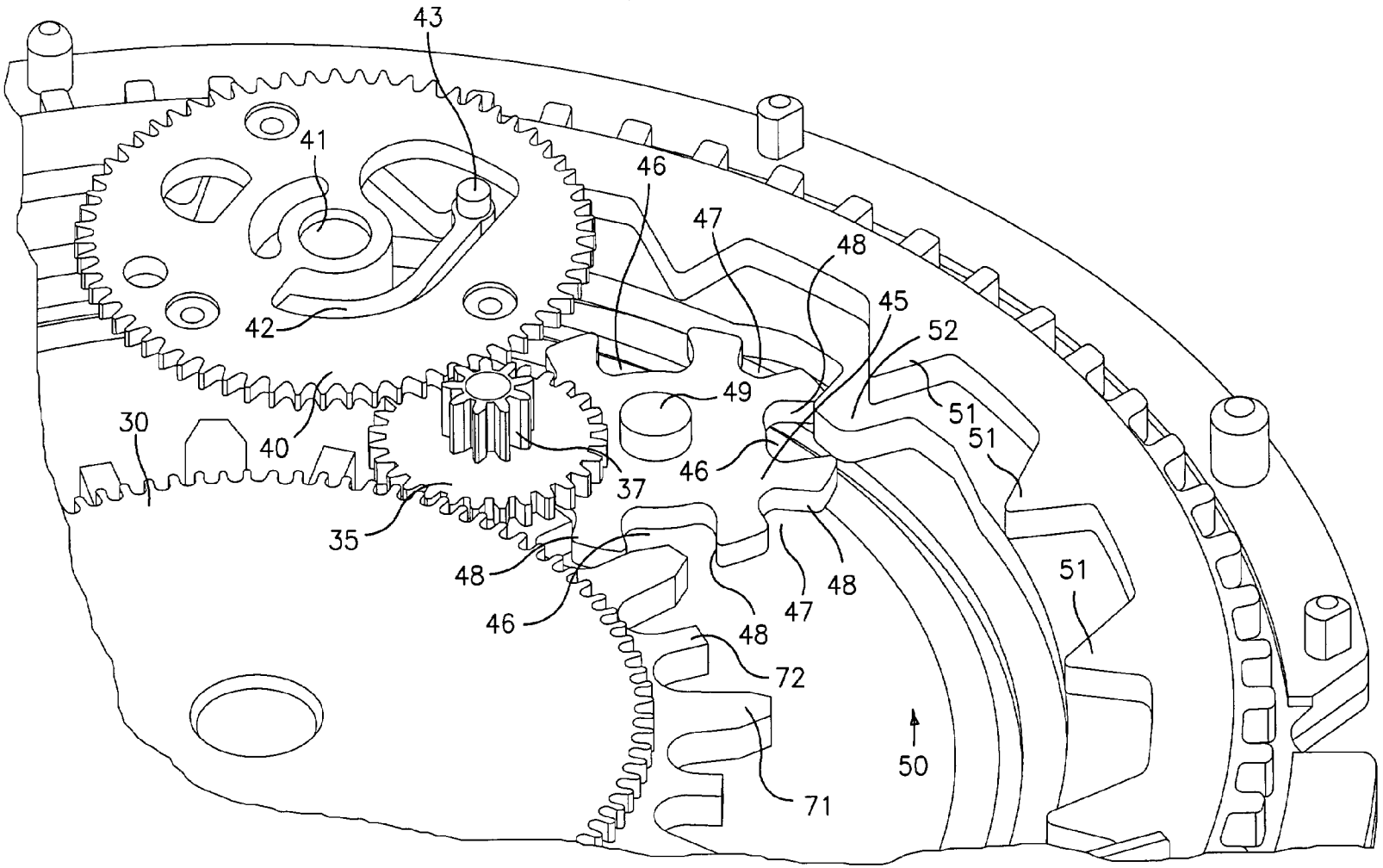
FIG. 5 is a close-up view of certain elements provided in the view of FIG. 4.
Figure 6:
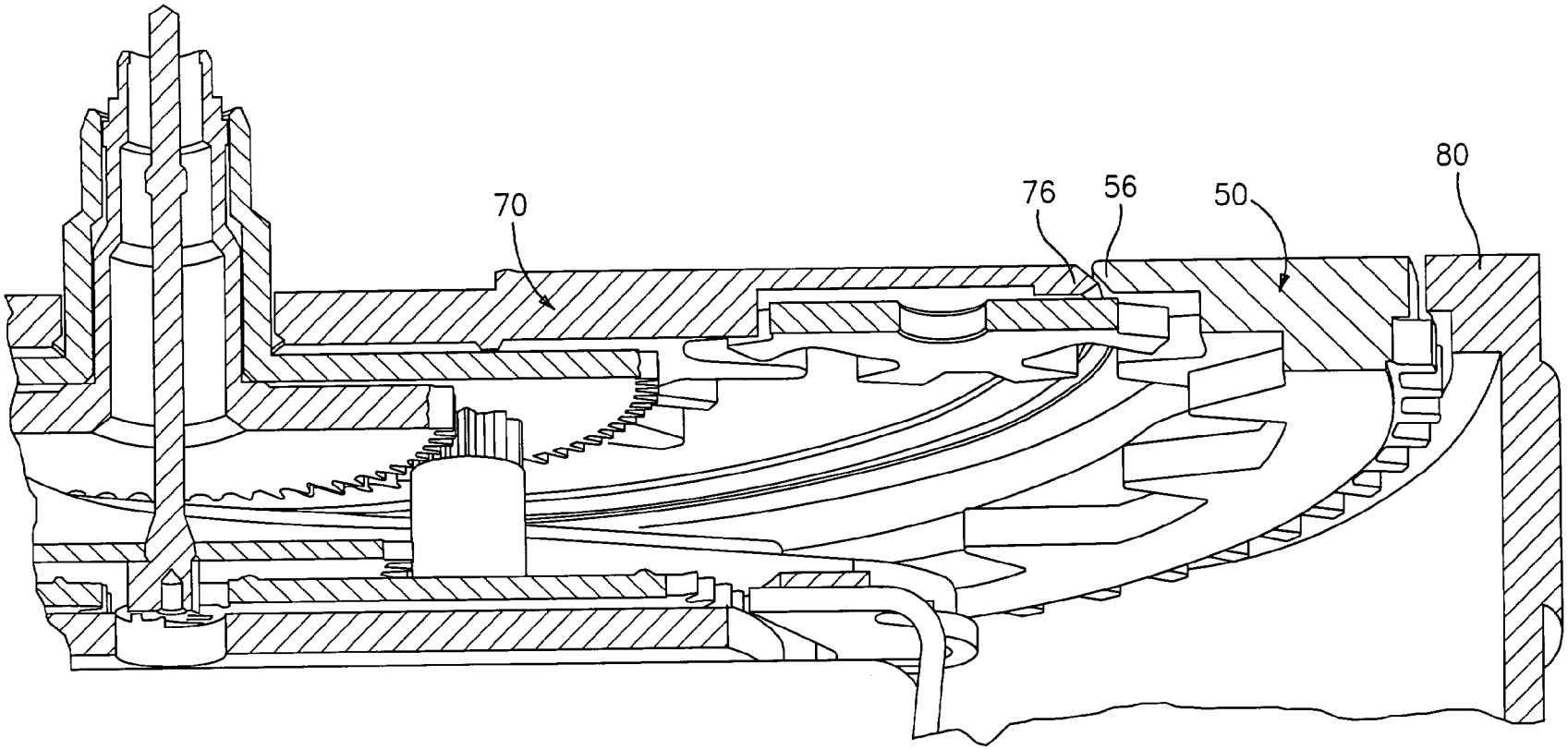
FIG. 6 is a cross-sectional view of the timepiece illustrated in FIG. 2.
Figure 7:
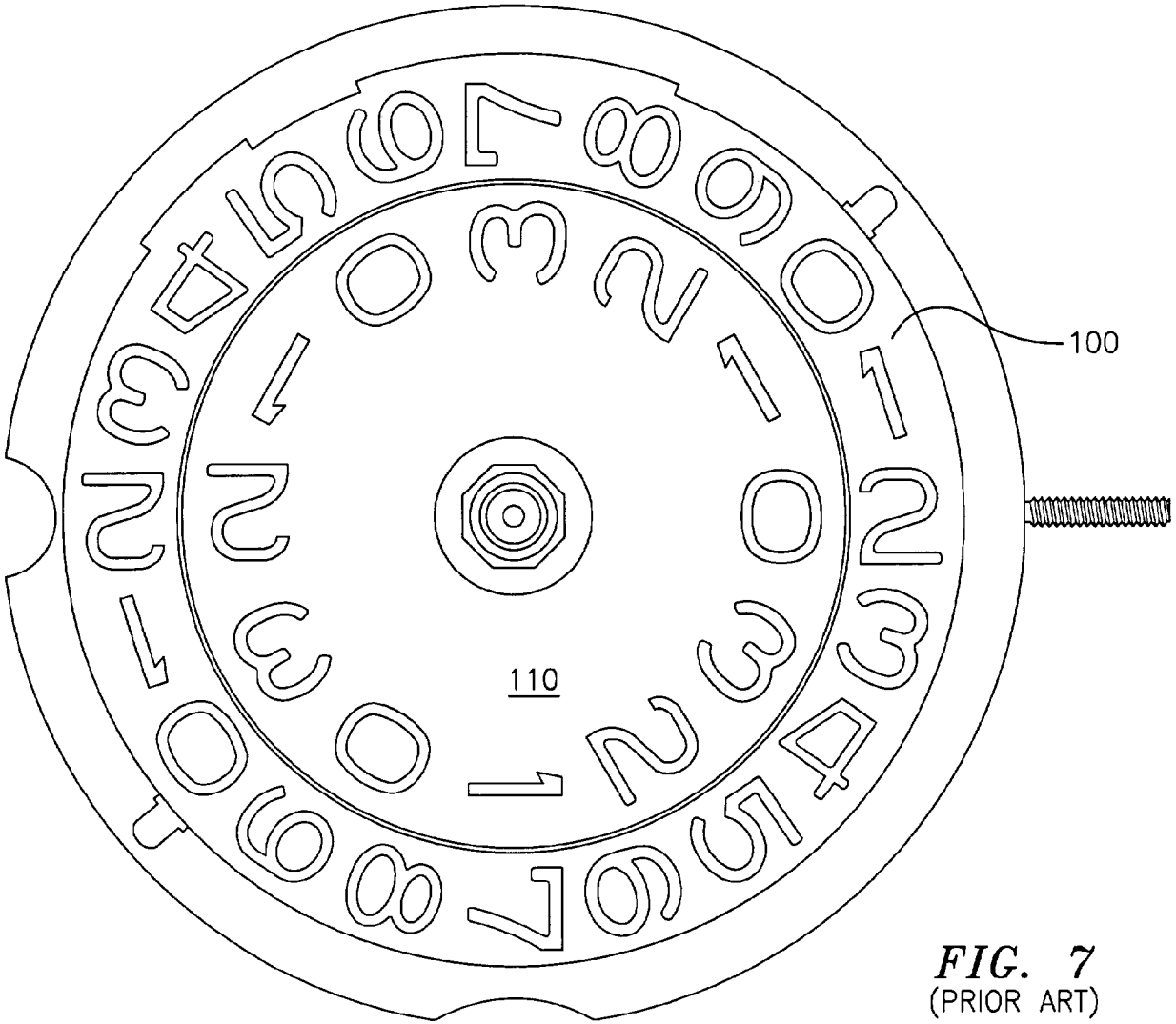
FIG. 7 (PRIOR ART)
FIGS. 7–8 illustrate the mechanical workings of a prior art two-date ring construction.
Figure 8:
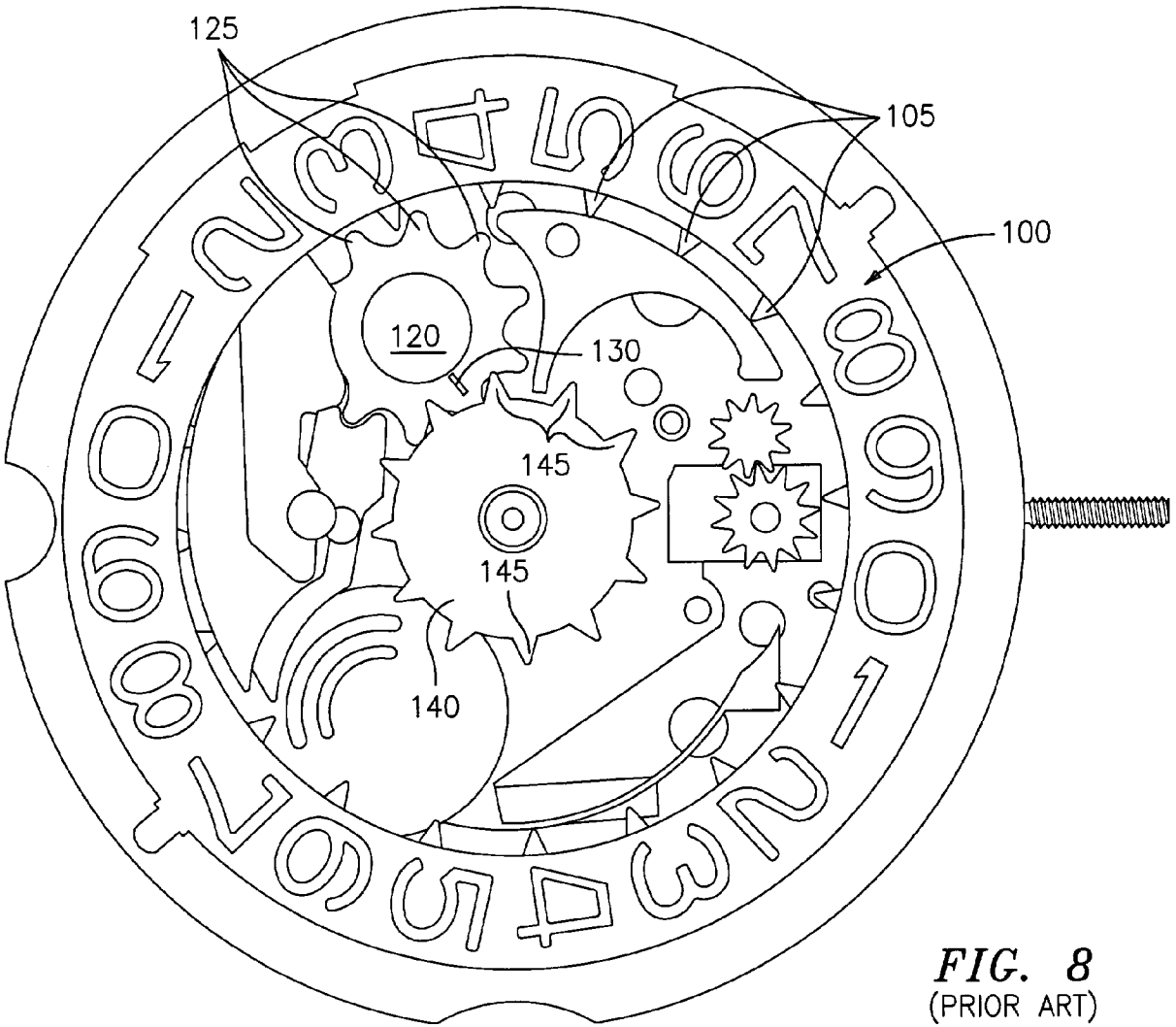
FIG. 8 (PRIOR ART)

Particularly reference is now made to FIGS. 4 and 5 for a disclosure on how date wheel 40 drives outer date ring 50. Specifically, date wheel 40 includes a resilient arm 42 with a hand 43 at the end thereof, all of which may be integrally molded together from plastic. From the perspective of FIG. 3, date wheel 40 (and hence outer date ring 50) will rotate in the clockwise direction (of course due to hour wheel 30 rotating in the clockwise direction), while in the view of FIG. 5, date wheel 40 (and hence outer date ring 50) will rotate in the counterclockwise direction. Each time date wheel 40 rotates one revolution, it is desirable that hand 43 of resilient arm 42 engage and cause the incremental rotation of outer date ring 50.

Specifically, outer date ring 50 includes a plurality of triangularly shaped teeth 51. With each rotation of resilient arm 42, hand 43 will rotate around and urge forward (in the counterclockwise direction when viewed in FIG. 5) the tooth with which it will next contact, thus causing outer date ring 50 to rotate once every 24 hours of perceived or actual rotation of hour wheel 30. From the foregoing, one can therefore see how outer date ring 50 rotates upon the rotation of hour wheel 30, as the sizing of the wheels are coordinated so that each two revolutions (i.e. 24 hours) of wheel 30 causes a full revolution of wheel 40 which causes the appropriate angular rotation of outer date ring 50.

Outer date ring 50 further includes two notches 52, 53 located slightly inwardly and, in the preferred embodiment, slightly below the plane that includes teeth 51. In this way, notches 52, 53 lie in the plane with wheel 45. These two notches 52, 53 are preferably molded on the underside surface of outer date ring 50 and are spaced directly opposite each other so as to cause the rotation of driving wheel 45 once every $10^{th}$ actual or perceived day. These notches 52, 53 can be thought of as the "tens digit" driving information, because it is the interaction of wheel 45 (as discussed below) with these notches that cause the incrementing of the tens digit (i.e. from "09" to "10" and from "19" to "20" for example). These notches are the elements that are responsible for "signaling" the needed change of the tens digit of the date and the corresponding engagement of wheel 45 with one of the notches 52, 53. Moreover, driving wheel 45 rotates only when it is time to rotate the inner date ring.

From the foregoing, it can be seen that there is no need to precisely align either the inner date ring or driving wheel 45, since any initial or later resulting misalignment can be easily corrected by the appropriate advancement of the outer date ring, since the signaling elements, namely notches 52, 53 are always aligned in the same location on outer date ring 50. With the "signaling" occurring by the notches on the outer date ring 50 and the advancement of the inner date ring occurring as a result of the rotation of wheel 45 as disclosed herein, the inventors hereof are assured a workable orientation no matter what the alignment is during assembly of the related components or resulting from a intermittent misalignment during later operation. That is, there is no possibility of permanent misalignment.

Moreover, notches 52, 53 are aligned and located on the undersurface of date ring 50 so that when the date goes from the $9^{th}$ to the $10^{th}$ of the month, from the $19^{th}$ to the $20^{th}$ of the month or the $29^{th}$ to the $30^{th}$ of the month, the respective notch 52 or 53 will engage driving wheel 45 and urge it in a counterclockwise direction (when viewing from FIG. 5). It should thus be understood that notches 52 and 53 need to be positioned taking into consideration the location of the display window and the positions of the various wheels. In the preferred embodiment, although this is only by way of example and not limitation, the notches are located approximately under the "4's" of outer date ring 50. It can also be seen that this arrangement advantageously does not require the precision alignment of the outer date ring with respect to the inner date ring because the notches are positioned on the underside of outer ring 50.

Turning to the particulars of driving wheel 45, it can be seen to have a plurality of slots, preferably four larger slots 46 alternating with four smaller slots 47. As outer date ring 50 rotates counterclockwise in FIG. 5, notches 52 and 53 will each respectively contact an inner wall 48 of the larger slot 46 to thus urge driving wheel 45 in the counterclockwise direction about its stem 49. The engagement of the respective notch 52 or 53 with each inner wall 48 is sufficient to cause driving wheel 45 to rotate sufficiently so that upon the next engagement of the other of notches 52 and 53, it is with the next larger slot 46, and not undesirably with one of the smaller slots 47. From the foregoing, one skilled in the art could properly dimension driving wheel 45, its respective slots 46 and 47 and the size of notches 52, 53 to ensure the proper amount of rotation of driving wheel 45 with each successive rotation caused by the notches 52, 53.

Inner date ring 70 also includes a plurality of teeth on an interior sprocket that is preferably molded therewith, although the sprocket may be separate therefrom and coupled thereto, such as in a way similar to the cited prior art centerwheel. The teeth are preferably comprised of alternating larger teeth 71 and smaller teeth 72.

Driving wheel 45 is oriented such that the smaller slots 47 receive and engage the smaller teeth 72, while the larger slots 46 receive and engage the larger teeth 71. Specifically, it was determined that the size of large slot 46 did not provide the desired amount of urging force to the sprocket of inner date ring 70, thus requiring the assistance of the plurality of smaller slots 47. More specifically, the slots of the wheel 45 and meshing teeth of the inner date ring are designed to avoid torque peaks while gearing, so as to not unduly burden the driving motor. As such, slots 46, 47 and corresponding teeth 71, 72 comprise a geometry to provide a very homogeneous transmission rate, another novel feature provided hereby. Hence, the sprocket of inner date ring 70 needs correspondingly sized teeth to accommodate and engage each sized slot 46, 47.

It can thus be seen how the rotation of outer date ring 50 is directly caused by the rotation of driving wheel 40, and in particular, the urging of arm 42 against each one of the teeth 51. In turn, it can be seen how the rotation of driving wheel 45 is directly caused by the urging of notches 52, 53 against the inner walls 48 of larger slots 46. Still further, it can thus be seen how the rotation of inner date ring 70 is caused by the urging of the inner walls of the respective larger slots 46 and smaller slots 47 against teeth 71, 72.

From the foregoing, it can be seen that an improved date display assembly can be provided by the use of two date rings. Furthermore, the use of the date rings in accordance with the foregoing will require a user to adjust the displayed date at or about the end of each month, because it can be seen that the next displayed date after "31" for example will be "32," and not "1." Thus a user is required to be more aware of the settings on his/her own watch, another advantage afforded by the present invention.

In accordance with another feature of the present invention, outer date ring 50 comprises an angled inner edge 56, while inner date ring 70 comprises a complementary angled outer edge 76. In this way, only the outer date ring 50 needs to be locked down by conventional methods such as by ring 80. Outer ring 70 is also biased in place by one or more spring arms 85. In this way, the present invention allows for the outer date ring 50 to provide a self-locking inner date ring feature. The construction is as follows: inner date ring 70 is restrained from vertical movement at its outermost edge by the complementary beveled edge 56, thereby ensuring that the inner date ring 70 can remain properly positioned without the use of any clamps, springs or other lockdown components on the outer edge of ring 70. On the other hand, outer date ring 50 is held down by ring 80. Hence a two-ring date display assembly can be configured with a minimum number of parts, thus achieving another advantage of ease and simplicity in assembly construction. Moreover, it can be seen that the wheel 45 is horizontally aligned with the inner and outer date rings, as set forth above. Still further, the dial, which one would readily appreciate is positioned on top of the inner and outer date rings, also provides the function of keeping the rings vertically restrained.

While the invention has been particularly shown and described with respect to preferred embodiments thereof, it will be understood by those skilled in the art that changes in form and details may be made therein without departing from the scope and spirit of the invention. It should also be understood that reference to rotatable "engagement" or "meshing" or similar terms are all used interchangeably and not intended to indicate different meanings.

For example, the present invention has been disclosed above with particular reference to timepieces. However, one skilled in the art shall now appreciate that the present invention is equally applicable, and as claimed herein, to devices other than timepieces, such as, but not limited to clocks.

By way of background, one may wish to review U.S. Pat. No. 5,305,291, 5,742,565, 5,446,703, or 5,210,772, or the subject matter of a copending application entitled Hour Hand Setting Assembly For An Analog Timepiece, Attorney Docket No. A0713A, filed on Dec. 30, 2002 to Siegfried Grau, the subject matter of all these patents and application being incorporated by references as if fully set forth herein.

What is claimed is:

1. A date display assembly for a timepiece, wherein the timepiece comprises a casing, an hour wheel that is rotationally engaged with a meshing wheel, and a display window for displaying a date, the date display assembly comprising:

an outer date ring having a plurality of digits thereon and aligned in the casing such that each of the plurality of digits is appearable in the display window, wherein the underside of the outer date ring comprises at least two signaling notches spaced apart from one another;

a date wheel, rotatably engageable with the meshing wheel, for rotating the outer date ring in a first direction;

an inner date ring driving wheel, having a plurality of alternating large and small slots for rotating an inner date ring in a direction opposite the first direction; and an inner date ring having a plurality of digits thereon and also aligned in the casing such that each of the plurality of digits is appearable in the display window, the inner date ring having a plurality of alternating large and small teeth on the underside surface thereof that respectively engage the plurality of large and small slots, wherein the at least two signaling notches engage the plurality of large slots of the inner date driving wheel and the plurality of alternating large and small slots of the inner date driving wheel cause the rotation of the inner date ring.

2. The date display assembly as claimed in claim 1, including a plurality of digits numbered "0–9" on a top surface of the outer date ring and wherein said plurality of digits are repeated, and including a plurality of digits number "0–3" on a top surface of the inner date ring and wherein the plurality of digits on the inner date ring are repeated twice;

and wherein there are two signaling notches located opposite each other on the underside of the outer date ring.

3. The date display assembly as claimed in claim 1, wherein the inner date driving wheel comprises four large slots that alternate with four small slots, and wherein the signaling notches engage and urge the rotation of the inner date driving wheel by their engagement of and being received by the large slots of the inner date driving wheel.

4. A date display assembly for a timepiece, wherein the timepiece comprises a casing, an hour wheel that is rotationally engaged with a meshing wheel, and a display window for displaying a date, the date display assembly comprising:

an outer date ring having a plurality of digits thereon and aligned in the casing such that each of the plurality of digits is appearable in the display window, wherein the underside of the outer date ring comprises at least two signaling notches spaced apart from one another;

a date wheel, rotatably engageable with the meshing wheel, for rotating the outer date ring in a first direction;

an inner date ring driving wheel, comprising four large slots that alternate with four small slots for rotating an inner date ring in a direction opposite the first direction; and an inner date ring having a plurality of digits thereon and also aligned in the casing such that each of the plurality of digits is appearable in the display window, the inner date ring comprising a plurality of alternating large and small teeth on the underside surface thereof that respectively engage the plurality of large and small slots, wherein the at least two signaling notches engage to the plurality of large slots of the inner date driving wheel and the plurality of alternating large and small slots of the inner date driving wheel cause the rotation of the inner date ring, and wherein the at least two signaling notches engage and urge the rotation of the inner date driving wheel by their engagement of and being received by the large slots of the inner date driving wheel; and wherein the small slots engage and urge the rotation of the inner date driving wheel by their engagement of and being received by the small teeth of the inner date driving wheel;

whereby the alternating large and small slots of the inner date driving wheel respectively engage the large and small teeth of the inner date ring and urge the rotation of the inner date ring.

5. A date display assembly for a timepiece, wherein the timepiece comprises a casing, and a display window for displaying a date, the date display assembly comprising:

an inner date ring having a plurality of digits thereon and aligned in the casing such that each of the plurality of digits is appearable in the display window;

an outer date ring having a plurality of digits thereon and also aligned in the casing such that each of the plurality of digits is appearable in the display window;

wherein the inner date ring has an angled outer edge and the outer date ring has a complementary angled inner edge, wherein the angled inner edge of the outer date ring overlies and restricts the movement of the outer edge of the inner date ring towards the display window; and a lockdown ring, coupled to the casing, for locking down the outer ring.

* * * * *